US010012960B2

(12) United States Patent
Zhang

(10) Patent No.: US 10,012,960 B2
(45) Date of Patent: Jul. 3, 2018

(54) WATCH

(71) Applicant: BOE TECHNOLOGY GROUP CO., LTD., Beijing (CN)

(72) Inventor: Xiangyan Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/325,058

(22) PCT Filed: Feb. 26, 2016

(86) PCT No.: PCT/CN2016/074638

§ 371 (c)(1),
(2) Date: Jan. 9, 2017

(87) PCT Pub. No.: WO2017/045369

PCT Pub. Date: Mar. 23, 2017

(65) Prior Publication Data

US 2017/0293267 A1 Oct. 12, 2017

(30) Foreign Application Priority Data

Sep. 16, 2015 (CN) ..... 2015 1 0591555

(51) Int. Cl.
*G04G 21/08* (2010.01)
*G04C 10/02* (2006.01)
(Continued)

(52) U.S. Cl.
CPC ..... *G04G 21/08* (2013.01); *G04B 19/04* (2013.01); *G04B 19/06* (2013.01); *G04C 10/02* (2013.01); *G04G 9/00* (2013.01)

(58) Field of Classification Search
CPC ..... G04G 21/08; G04G 9/00; G04G 7/00; G04G 9/0082; G04G 9/02; G04G 9/027;
(Continued)

(56) References Cited

U.S. PATENT DOCUMENTS 6,600,527 B1 * 7/2003 Basturk ..... G02F 1/133536 349/115
6,779,917 B1 * 8/2004 Chappuis ..... G04B 37/0083 368/276
(Continued)

FOREIGN PATENT DOCUMENTS

CN 1113017 A 12/1995
CN 1122463 A 5/1996
(Continued)

OTHER PUBLICATIONS

International Search Report and Written Opinion in PCT/CN2016/074638 dated Jun. 21, 2016, with English translation. 17 pages.
(Continued)

*Primary Examiner* — Edwin A. Leon
(74) *Attorney, Agent, or Firm* — Womble Bond Dickinson (US) LLP

(57) ABSTRACT

A watch including: a rear cover; a dial fixedly connected with the rear cover, the dial and the rear cover defining a first cavity; a transparent touch screen located on a side of the dial facing away from the rear cover and fixedly connected with the dial, the transparent touch screen and the dial defining a second cavity; at least one pointer located in the second cavity and being rotatable relative to the dial; and a driving system located in the first cavity and configured to drive the at least one pointer to rotate and the transparent touch screen to operate.

18 Claims, 4 Drawing Sheets

(51) Int. Cl.
*G04G 9/00* (2006.01)
*G04B 19/06* (2006.01)
*G04B 19/04* (2006.01)

(58) Field of Classification Search
CPC ..... G04G 9/04; G04G 9/047; G04B 19/04; G04B 19/06; G04B 19/00; G04B 19/23; G04B 19/34; G04C 10/02
USPC ..... 368/205
See application file for complete search history.

(56) References Cited

U.S. PATENT DOCUMENTS

| | | | | |
|---|---|---|---|---|
| 2008/0151700 | A1* | 6/2008 | Inoue | B60K 37/02 368/80 |
| 2015/0078144 | A1* | 3/2015 | Gong | G04C 17/0041 368/228 |

FOREIGN PATENT DOCUMENTS

| | | | |
|---|---|---|---|
| CN | 2598026 | Y | 1/2004 |
| CN | 2791708 | Y | 6/2006 |
| CN | 101055464 | A | 10/2007 |
| CN | 201477386 | U | 5/2010 |
| CN | 202141901 | U | 2/2012 |
| CN | 102636986 | A | 8/2012 |
| CN | 202837844 | U | 3/2013 |
| CN | 103472708 | A | 12/2013 |
| CN | 203465525 | U | 3/2014 |
| CN | 203799188 | U | 8/2014 |
| CN | 203882101 | U | 10/2014 |
| CN | 204065687 | U | 12/2014 |
| CN | 204086831 | U | 1/2015 |
| CN | 204116821 | U | 1/2015 |
| CN | 204241855 | U | 4/2015 |
| CN | 204422983 | U | 6/2015 |
| CN | 204440022 | U | 7/2015 |
| CN | 105093909 | U | 11/2015 |
| CN | 204945629 | U | 1/2016 |
| JP | S 6080319 | A | 5/1985 |
| JP | H 08146897 | A | 6/1996 |

OTHER PUBLICATIONS

Office Action in Chinese Application No. 201510591555.2 dated Jan. 16, 2017, with English translation. 16 pages.
Office Action in Chinese Application No. 201510591555.2 dated Sep. 8, 2017, with English translation.
Office Action received for Chinese Patent Application No. 201510591555.2, dated Mar. 6, 2018, 32 pages (20 pages of English Translation and 12 pages of Office Action).
International Preliminary Report on Patentability received for PCT Patent Application No. PCT/CN2016/074638, dated Mar. 29, 2018, 14 pages (9 pages of English Translation and 5 pages of Original Document).

* cited by examiner

WATCH

The present application is the U.S. national phase entry of PCT/CN2016/074638, with an international filing date of Feb. 26, 2016, which claims the benefit of Chinese Patent Application No. 201510591555.2, filed on Sep. 16, 2015, the entire disclosures of which are incorporated herein by reference.

TECHNICAL FIELD

The present disclosure relates to the field of display technologies, and particularly to a watch.

BACKGROUND

Due to their classical appearance designs, traditional high-class watches through the ages have high brand value. However, traditional watches can only tell the time and cannot satisfy people's demands for smart wearable devices. Some current smart watches do have smart functionality, but they cannot achieve classical appearance of traditional watches, and thus cannot satisfy people's demands for brand value.

Therefore, there is a need for implementing compatibility of a traditional watch with a smart watch.

SUMMARY

In view of this, embodiments of the present disclosure provide a watch which may implement compatibility of a traditional watch with a smart watch.

According to an aspect of the present disclosure, a watch is provided including: a rear cover; a dial fixedly connected with the rear cover, the dial and the rear cover defining a first cavity; a transparent touch screen located on a side of the dial facing away from the rear cover and fixedly connected with the dial, the transparent touch screen and the dial defining a second cavity; at least one pointer located in the second cavity and being rotatable relative to the dial; and a driving system located in the first cavity and configured to drive the at least one pointer to rotate and the transparent touch screen to operate.

In a possible implementation, the driving system includes a mechanical driving mechanism for driving the pointer to rotate and a driving circuit for driving the transparent touch screen to operate.

In a possible implementation, the transparent touch screen includes a transparent display screen and a transparent touch control module, and the touch control module is located inside the display screen or on a side of the display screen facing away from the dial.

In a possible implementation, the watch further includes a solar cell located on a side of the display screen facing the dial.

In a possible implementation, the solar cell overlaps at least a portion of a display area of the display screen, and the solar cell is transparent.

In a possible implementation, the solar cell is a dye-sensitized solar cell.

In a possible implementation, the solar cell has a substrate which is shared with the display screen.

In a possible implementation, the solar cell overlaps at least a portion of a non-display area of the display screen, and the solar cell is an inorganic semiconductor solar cell or organic solar cell.

In a possible implementation, the display screen is any one of organic electroluminescent display, a liquid crystal display and an electrochromic display.

In a possible implementation, the display screen is an organic electroluminescent display or an electrochromic display, and the dial is made of a solar cell panel.

In a possible implementation, the display screen is a liquid crystal display including a liquid crystal display panel and a backlight module, and the backlight module is reused as the dial.

In a possible implementation, the watch further includes a watch strap connected with the rear cover and a flexible solar cell located on a surface of the watch strap.

In a possible implementation, the flexible solar cell is an organic solar cell.

In a possible implementation, the watch further includes a button exposed out of the rear cover and used to switch display modes of the watch.

In a possible implementation, the watch further includes a button exposed out of the rear cover and used to adjust a sound volume.

The idea of the present disclosure lies in replacing the transparent front cover of a traditional watch with a transparent touch screen. In a conventional display mode, the touch screen is in a transparent state to enable the watch to have a classical appearance of the traditional watch. In a smart display model, the touch screen may display content and operate in response to a touch input. In this way, the watch has not only a classical appearance of the traditional watch but also smart functionality. Thereby, compatibility of the traditional watch with the smart watch is implemented.

DETAILED DESCRIPTION

Embodiments of the present disclosure are described in detail with reference to the drawings. It should be appreciated that the drawings are not necessarily drawn to scale and are only shown for purposes of illustration.

Figure 1:
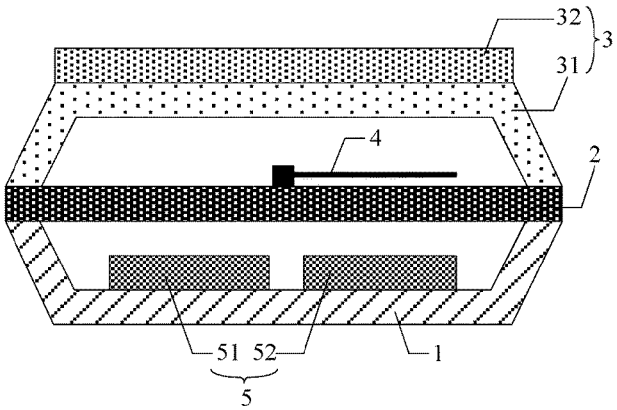
FIG. 1 is a structural schematic view of a watch according to an embodiment of the present disclosure.

FIG. 1 is a structural schematic view of a watch according to an embodiment of the present disclosure. As shown in FIG. 1, the watch includes a rear cover 1 and a dial 2 fixedly connected with the rear cover 1. The dial 2 and the rear cover 1 define a first cavity. In this example, the dial 2 has a flat plate-shaped structure, and an edge portion of the rear cover 1 bends toward the dial 2 so that the dial 2 and the rear cover 1 together define the first cavity.

The watch further includes a transparent touch screen 3 which is located on a side of the dial 2 facing away from the rear cover 1 and fixedly connected with the dial 2. The transparent touch screen 3 and the dial 2 define a second cavity. In this example, an edge portion of the touch screen 3 bends toward the dial 3 so that the touch screen 3 and the dial 2 jointly define the second cavity. At least one pointer 4 is located in the second cavity and is rotatable relative to the dial 2.

It should be appreciated that "fixedly connected" as used herein may include both a detachable connection and an undetachable connection. In addition, "transparent" as used herein may refer to "at least partially transparent".

Furthermore, as shown in FIG. 1, the transparent touch screen 3 may include a transparent display screen 31 and a transparent touch control module 32. In an implementation, the touch control module 32 may be located inside the display screen 31, namely, the touch screen 3 may be an in-cell touch panel. In another implementation, as shown in FIG. 1, the touch control module 32 may be located on a side of the display screen 31 facing away from the dial 2, and the touch control module 32 may share with the display screen 31 a substrate located therebetween. In other words, the touch screen 3 may be an on-cell touch panel. In a further implementation, a substrate of the touch control module 32 may be fit with a substrate of the display screen 31 so that the touch screen 3 is an add-on touch panel. In this example, although the touch control module 32 is illustrated as being arranged to correspond to a platform area of the display screen 31, other configurations are possible.

In addition, the watch further includes a driving system 5 located in the first cavity and configured to drive the at least one pointer 4 to rotate and drive the transparent touch screen 3 to operate. In this example, the driving system 5 includes a driving mechanism 51 for driving the pointer 4 to rotate and a driving circuit 52 for driving the transparent touch screen 3 to operate. The driving mechanism 51 may employ a driving mechanism in a traditional watch (e.g., a mechanical watch or a quartz watch).

Figure 2:
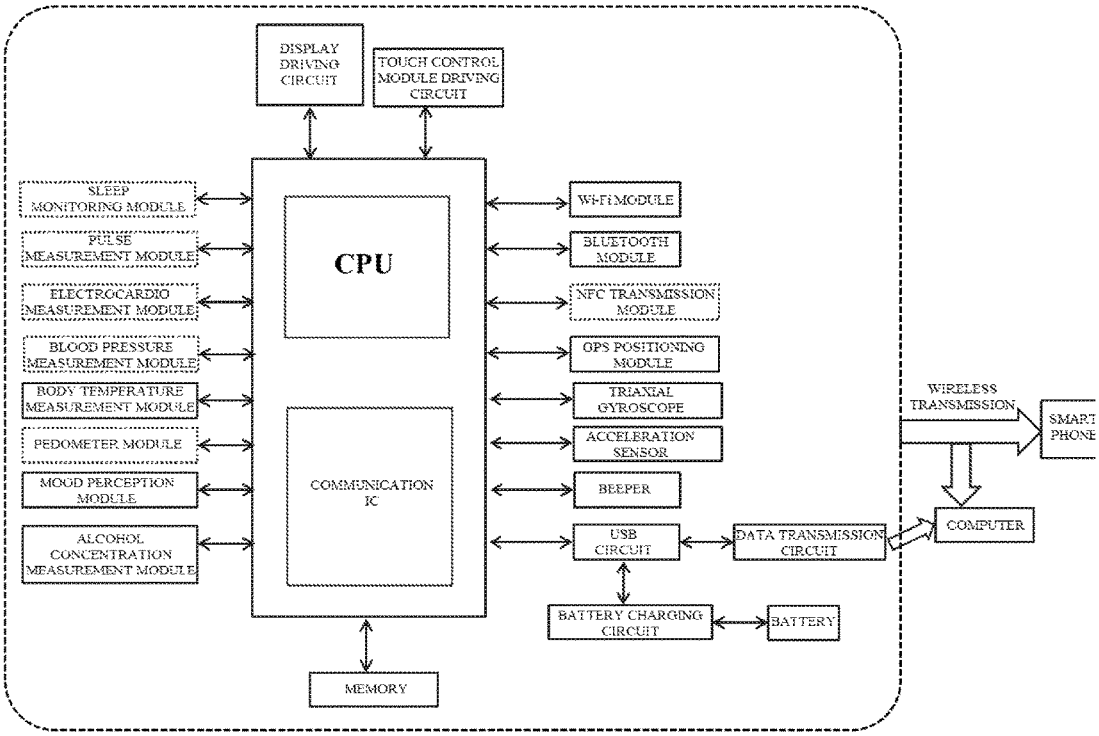
FIG. 2 is a block diagram of a driving circuit of a watch according to an embodiment of the present disclosure.

FIG. 2 is a block diagram of the driving circuit 52 of a watch according to an embodiment of the present disclosure. As shown in FIG. 2, the driving circuit 52 may include a central processing unit (CPU), one or more communication ICs, a display driving circuit, a touch control module driving circuit and one or more optional peripheral modules. These peripheral modules may include various sensors, communication interface modules and modules for implementing additional smart functionality. The additional smart functionality may include music play, body temperature measurement, mood perception, electronic payment, and the like. It is possible to add corresponding functions according to specific demands.

By way of example, and not limitation, the display screen 31 may be any one of an organic electroluminescent display, a liquid crystal display (LCD) and an electrochromic display (ECD). Transparency design of these types of displays is known and is not a focus of the subject matter of the present disclosure.

Figure 3:
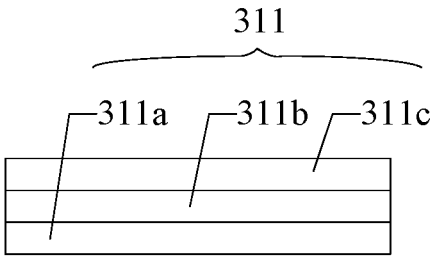
FIGS. 3 to 5 are structural schematic views of parts in touch screens of watches according to various embodiments of the present disclosure, respectively.

In an embodiment in which the display screen 31 is an OLED display, the pointer is located in a cavity defined by the OLED display and the dial, and is rotatable relative to the dial. FIG. 3 schematically shows a structure of the OLED display. The OLED display includes a plurality of pixel units arranged in a matrix, and each of the pixel units includes an organic electroluminescent structure and a thin film transistor. Specifically, the organic electroluminescent structure 311 includes an anode 311*a*, a light-emitting layer 311*b* and a cathode 311*c* which are laminated on top of one another.

Figure 4:
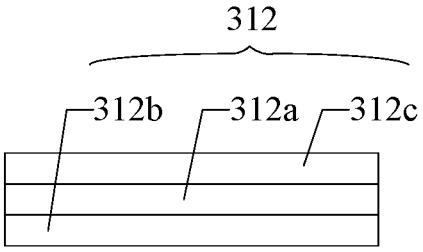

In an embodiment in which the display screen 31 is an ECD, the pointer is located in a cavity defined by the ECD and the dial, and is rotatable relative to the dial. FIG. 4 schematically shows a structure of the ECD. The ECD comprises a plurality of pixel units arranged in a matrix, and each of the pixel units includes an electrochromic structure and a thin film transistor. Specifically, the electrochromic structure 312 includes an electrochromic layer 312*a* and electrodes 312*b*, 312*c* located respectively on both sides of the electrochromic layer 312*a*. The electrodes 312*b*, 312*c* are generally made from indium tin oxide (ITO).

Figure 5:
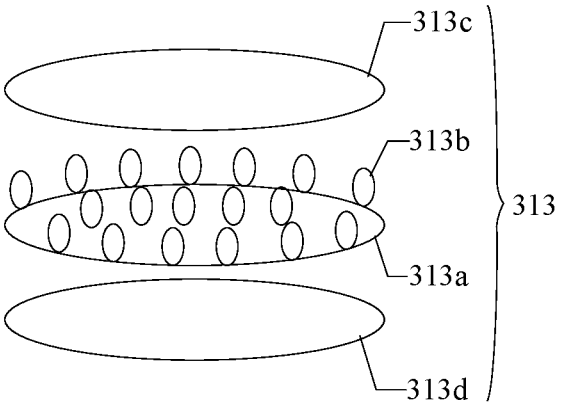

In an embodiment in which the display screen 31 is an LCD, the pointer is located in a cavity defined by the liquid crystal display panel of the LCD and the dial, and is rotatable relative to the dial. The liquid crystal display includes an opposite substrate and an array substrate which are arranged opposite to each other, and a liquid crystal layer located between the two substrates. In addition to the liquid crystal display panel, the LCD further includes a backlight module. FIG. 5 schematically shows a structure of an exemplary backlight module 313 of the LCD. The exemplary backlight module 313 includes a scatter plate 313*a*, a plurality of light sources 313*b* (e.g., light-emitting diodes, LEDs) that are evenly disposed on the scatter plate 313*a*, and a light guide plate 313*c* located above the light sources 313*b*. It is further feasible to dispose a heat sink 313*d* below the scatter plate 313*a* to prevent the backlight module 313 from malfunction due to an overly high temperature inside. Especially, in this embodiment, the backlight module 313 may be used as the dial.

Although various display screens are described above, the present disclosure is not limited thereto. In other embodiments, other types of transparent display screens are also possible.

To prolong standby duration of the watch, a solar cell may be disposed in the watch, by which a primary cell of the watch is charged. Alternatively or additionally, the solar cell may be used as the primary cell to power the watch directly.

Figure 6:
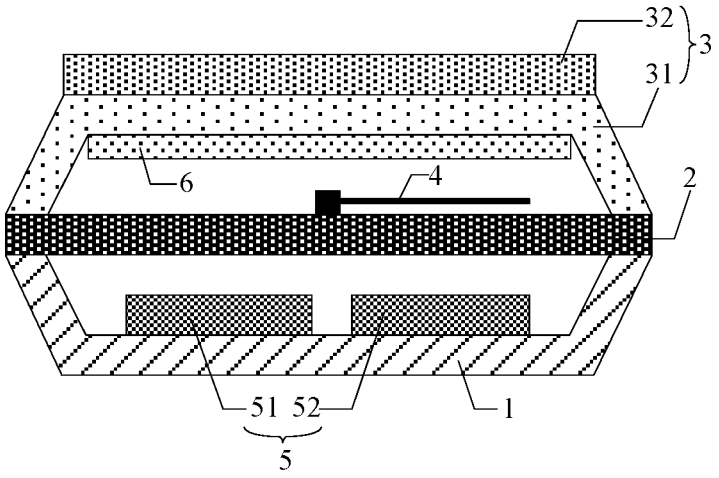
FIG. 6 is a structural schematic view of a watch according to an embodiment of the present disclosure.

FIG. 6 is a structural schematic view of a watch according to an embodiment of the present disclosure. As shown in FIG. 6, the watch includes a transparent solar cell 6 located on a side of the display screen 31 facing the dial 2. The transparent solar cell 6 permits the user to read time indicated by the pointer 4 on the dial 2 and to view content displayed on the display screen 31. As stated above, "transparent" as used herein may refer to "at least partially transparent".

As far as the solar cell is concerned, solar cells that are partially transparent are already known and solar cells that are completely transparent are under development. An example of the completely transparent solar cell includes the transparent luminescent solar concentrator (TLSC) which is reportedly promising. The TLSC is made of organic salts that can absorb ultraviolet rays and infrared rays at particular wavelengths. These organic salts emit invisible infrared rays with another wavelength. These invisible infrared rays are guided to an edge of the TLCS and then converted by an ordinary photovoltaic solar cell built in the edge into electrical energy. In an implementation, the transparent solar cell 6 may be a dye-sensitized solar cell. In other implementations, other types of transparent solar cells are also possible.

Since the transparent solar cell 6 is located on a side of the display screen 31 facing the dial 2, namely, the transparent solar cell 6 and the display screen 31 are of a stacked structure, the transparent solar cell 6 may share with the display screen 31 a substrate located therebetween. This way, the structure of the watch may be simplified and a thickness of the watch may be reduced.

Figure 7:
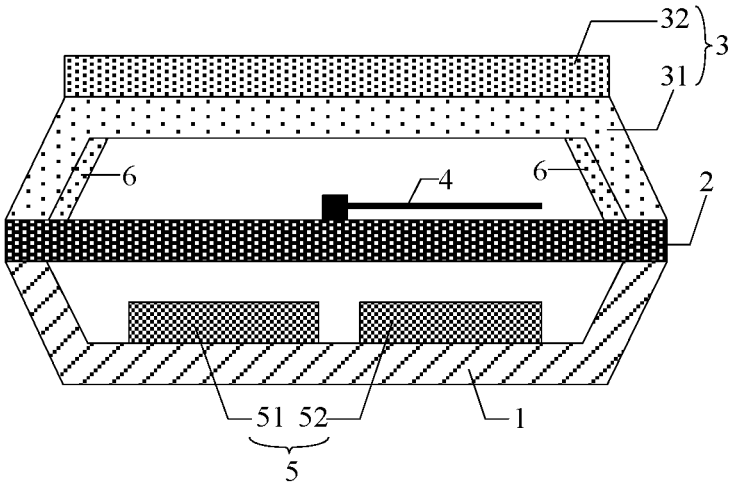
FIG. 7 is a structural schematic view of a watch according to another embodiment of the present disclosure.

FIG. 7 is a structural schematic view of a watch according to another embodiment of the present disclosure. As shown in FIG. 7, the watch includes a solar cell 6 located on a side of the display screen 31 facing the dial 2 and overlapping a non-display area of the display screen 31 (e.g., a peripheral area of the display screen 31). Since the solar cell 6 does not cover the display area of the display screen 31, the solar cell 6 may be an opaque solar cell such as an inorganic semiconductor solar cell (e.g., P-N junction solar cell or P-I-N junction solar cell) or an organic solar cell.

Arrangement of the solar cell 6 does not affect the user in reading the time indicated by the pointer 4 on the dial 2 and viewing the content displayed on the display screen 31. In an implementation, the solar cell 6 may be detachably disposed in the watch to facilitate replacement by the user.

Figure 8:
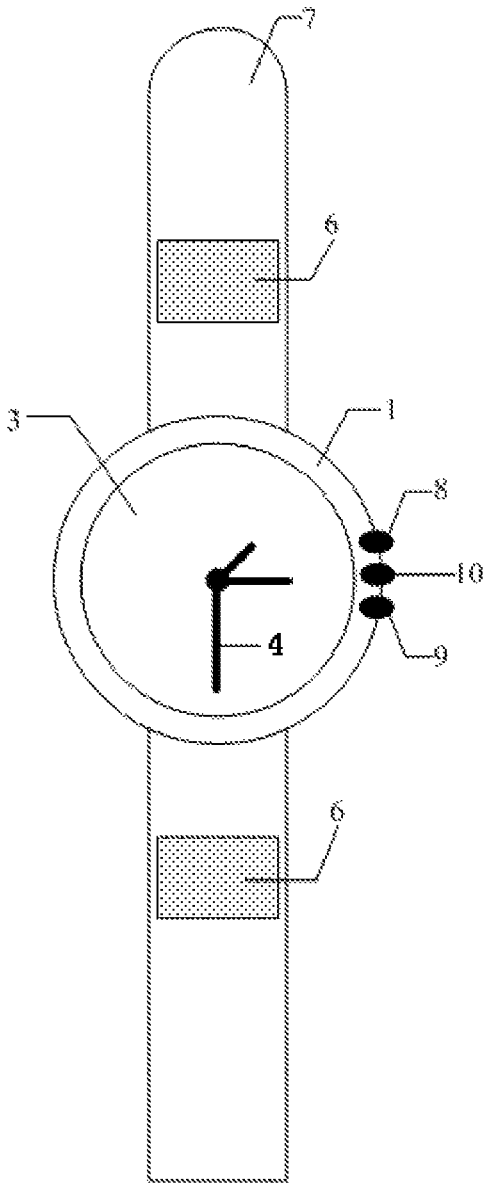
FIG. 8 is a structural schematic view of a watch according to a further embodiment of the present disclosure.

FIG. 8 is a structural schematic view of a watch according to a further embodiment of the present disclosure. As shown in FIG. 8, alternatively or additionally, the watch includes a watch strap 7 connected with the rear cover 1 and a flexible solar cell 6 located on the surface of the watch strap 7. Since the watch strap 7 is generally in contact with the user's wrist, the solar cell 6 located on the surface of the watch strap 7 needs to be flexible. The flexible solar cell 6 may charge the watch in real time, thereby solving the problem of a short standby duration of the watch.

In some implementations, a plurality of flexible solar cells may be disposed on the watch strap 7. The size of the flexible solar cells may be adjusted according to their locations. The flexible solar cells may be disposed evenly or unevenly on the watch strap 7. In some implementations, the flexible solar cells may have various colors and patterns. In some implementations, the flexible solar cells may further be detachably disposed on the watch strap 7 so that they can be easily replaced by the user. Especially, the flexible solar cells may be organic solar cells. Of course, other types of flexible solar cells are possible.

Although various arrangements of the solar cell 6 are described in the above embodiments, the present disclosure is not limited thereto. For example, in an embodiment in which the display screen 31 is an OLED display or an ECD, the dial 2 may be made of a solar cell panel. By way of example, and not limitation, the solar cell panel may be any one or more of an inorganic semiconductor solar cell, an organic solar cell and a dye-sensitized solar cell.

As shown in FIG. 8, the watch may further include a button 8 exposed out of the rear cover 1 and used to switch display modes. The display modes include a conventional display mode and a smart display mode. In the conventional display mode, the touch screen 3 is in a transparent state to enable the watch to have a classical appearance of a traditional watch. In the smart display model, the touch screen 3 may display content and operate in response to a touch input. Specifically, when the watch is in the conventional display mode, the user may read time via the pointer 4; when the watch is in the smart display mode, the user may use the finger to touch the touch screen 3 of the watch to implement a smart function.

In this example, the button 8 may be located on a side face of the watch so that it can be conveniently operated by the user. Of course, the button 8 may be omitted in other examples. In this case, the user may directly switch the display modes for example through operations on the touch screen 3. As such, the structure of the watch may be simplified, despite the problem of misoperations caused by failure to accurately distinguish between an inadvertent touch and an intentional touch by the user. Furthermore, if the user does not perform touch operation on the touch screen for a preset time, the smart display mode may automatically be switched to the conventional display mode. The preset time period may be set by the user, for example, as 30s.

As shown in FIG. 8, the watch may further include a button 9 exposed out of the rear cover 1 and used to adjust a sound volume. When the watch is in the smart display mode, for example, when it is playing music or video, the user may adjust the volume via the button 9. In this example, the volume-adjusting button 9 may be located on a side face of the watch so that it can be conveniently operated by the user.

As shown in FIG. 8, the watch may further include a button 10 disposed out of the rear cover 1 and used to adjust the time indicated by the pointer 4. In this example, the button 10 may be located on a side face of the watch so that it can be conveniently operated by the user.

In addition, as stated above, the watch may further include a primary cell (not shown) for powering the watch. In an implementation, the primary cell may be charged from an external power supply via a universal serial bus (USB) interface. Alternatively or additionally, the primary cell may be charged by a solar cell. In another implementation, the primary cell may also be charged by means of a wireless power transmission technology. For a pleasant appearance of the watch and other functional purposes (e.g., for waterproof), the USB interface may be designed to be concealed.

In the above embodiments, the watch is described and illustrated as having a circular shape as shown in FIG. 8 for purposes of illustration. In other embodiments, the watch may further have other shapes such as square or diamond.

By replacing the transparent front cover of a traditional watch with a transparent touch screen, the watch implements compatibility of the traditional watch with the smart watch. In the conventional display mode, the touch screen is in a transparent state to enable the watch to have a classical appearance of the traditional watch. In the smart display model, the touch screen may display content and operate in response to a touch input. In this way, the watch has not only a classical appearance of the traditional watch but also smart functionality.

Although the present disclosure has been illustrated and described in detail in the drawings and the forgoing depictions, such illustrations and depictions should be construed as being descriptive and illustrative, and not restrictive. The present disclosure is not limited to the disclosed embodiments.

Additionally, variations to the disclosed embodiments can be understood and effected by the skilled person in practicing the claimed subject matter, from a study of the drawings, the disclosure, and the appended claims. In the claims, the word "comprises" or "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. A watch, comprising:

a rear cover;

a dial fixedly connected with the rear cover, the dial and the rear cover defining a first cavity;

a transparent touch screen located on a side of the dial facing away from the rear cover and fixedly connected with the dial, the transparent touch screen and the dial defining a second cavity;

at least one pointer located in the second cavity and being rotatable relative to the dial; and a driving system located in the first cavity and configured to drive the at least one pointer to rotate and the transparent touch screen to operate, wherein the transparent touch screen comprises a transparent display screen and a transparent touch control module, and wherein the touch control module is located inside the display screen or on a side of the display screen facing away from the dial.

2. The watch of claim 1, wherein the driving system comprises a mechanical driving mechanism for driving the pointer to rotate and a driving circuit for driving the transparent touch screen to operate.

3. The watch of claim 1, further comprising a solar cell located on a side of the display screen facing the dial.

4. The watch of claim 3, wherein the solar cell overlaps at least a portion of a display area of the display screen, and the solar cell is transparent.

5. The watch of claim 4, wherein the solar cell is a dye-sensitized solar cell.

6. The watch of claim 3, wherein the solar cell has a substrate which is shared with the display screen.

7. The watch of claim 3, wherein the solar cell overlaps at least a portion of a non-display area of the display screen, and wherein the solar cell is an inorganic semiconductor solar cell or an organic solar cell.

8. The watch of claim 1, wherein the display screen is any one of an organic electroluminescent display, a liquid crystal display, or an electrochromic display.

9. The watch of claim 8, wherein the display screen is an organic electroluminescent display or an electrochromic display, and wherein the dial is made of a solar cell panel.

10. The watch of claim 8, wherein the display screen is a liquid crystal display including a liquid crystal display panel and a backlight module, and wherein the backlight module is reused as the dial.

11. The watch of claim 1, further comprising a watch strap connected with the rear cover and a flexible solar cell located on a surface of the watch strap.

12. The watch of claim 11, wherein the flexible solar cell is an organic solar cell.

13. The watch of claim 1, further comprising a button exposed out of the rear cover for switching display modes of the watch.

14. The watch of claim 1, further comprising a button exposed out of the rear cover for adjusting a sound volume.

15. The watch of claim 2, further comprising a button exposed out of the rear cover for switching display modes of the watch.

16. The watch of claim 3, further comprising a button exposed out of the rear cover for switching display modes of the watch.

17. The watch of claim 4, further comprising a button exposed out of the rear cover for switching display modes of the watch.

18. The watch of claim 5, further comprising a button exposed out of the rear cover for switching display modes of the watch.

* * * * *